US005741765A

United States Patent [19]

Leach

[11] Patent Number: 5,741,765

[45] Date of Patent: Apr. 21, 1998

[54] CLEANING COMPOSITION COMPRISING QUATERNISED POLY-DIMETHYLSILOXANE AND NONIONIC SURFACTANT

[75] Inventor: Matthew James Leach, Wirral, United Kingdom

[73] Assignee: Lever Brothers Company, Division of Conopco, Inc., New York, N.Y.

[21] Appl. No.: 605,410

[22] Filed: Feb. 22, 1996

[30] Foreign Application Priority Data

Feb. 23, 1995 [GB] United Kingdom ..... 9503596

[51] Int. Cl.[6] ..... C11D 1/12; C11D 1/755

[52] U.S. Cl. ..... 510/123; 510/466; 510/475; 510/504

[58] Field of Search ..... 510/123, 466, 510/475, 504

[56] References Cited

U.S. PATENT DOCUMENTS

| | | | |
|---|---|---|---|
| 3,679,592 | 7/1972 | Schoenberg | 252/153 |
| 4,005,024 | 1/1977 | Rodriguez et al. | 252/89 R |
| 4,005,025 | 1/1977 | Kinstedt | 252/89 R |
| 4,005,028 | 1/1977 | Heckert et al. | 252/99 |
| 4,005,030 | 1/1977 | Heckert et al. | 252/140 |
| 4,005,119 | 1/1977 | Heckert et al. | 428/543 X |
| 4,606,842 | 8/1986 | Keyes et al. | 252/174.23 |
| 4,639,321 | 1/1987 | Barret et al. | 252/8.8 |
| 4,690,779 | 9/1987 | Baker et al. | 252/546 |
| 4,871,530 | 10/1989 | Grollier et al. | 510/123 X |
| 4,891,166 | 1/1990 | Schaefer et al. | 556/418 X |
| 5,246,607 | 9/1993 | Schaefer et al. | 252/389.32 |

FOREIGN PATENT DOCUMENTS

| | | |
|---|---|---|
| 1077510 | 5/1980 | Canada . |
| 180 253 | 5/1986 | European Pat. Off. . |
| 0 354 856 | 2/1990 | European Pat. Off. . |
| 0 379 256 | 7/1990 | European Pat. Off. . |
| 0 467 472 | 1/1992 | European Pat. Off. . |
| 0 506 312 | 9/1992 | European Pat. Off. . |
| 0 530 974 | 3/1993 | European Pat. Off. . |
| 4-163374 | 6/1992 | Japan . |
| 1 528 592 | 10/1978 | United Kingdom . |
| 1 534 722 | 12/1978 | United Kingdom . |
| WO 88/09734 | 12/1988 | WIPO . |
| WO 91/09930 | 7/1991 | WIPO . |

*Primary Examiner*—Michael Lusignan
*Attorney, Agent, or Firm*—A. Kate Huffman

[57] ABSTRACT

Improved compositions which clean a surface and are believed to deposit thereupon a layer of cationic surfactant which assists the release of soil subsequently deposited upon the said surface comprising surfactant, wherein said surfactant comprises:

a) at least 65% wt on total surfactant of nonionic surfactant, b) less than 1% wt on total surfactant of anionic surfactant, and, c) 0.1–35% wt on total surfactant of a quaternized polydimethylsiloxane, preferably one which comprises a cation of the general formula:

$$[R_1R_2R_3N—Z—[Si(CH_3)_2—O]_nSi(CH_3)_2—Z—NR_4R_5R_6]^{2+}$$

wherein $R_1$, $R_2$, $R_3$, $R_4$, $R_5$ and $R_6$ are independently alkyl or hydrogen, Z is $—CH_2—CHOH—CH_2O—(CH_2)_3—$ and n is 1–200.

9 Claims, No Drawings

CLEANING COMPOSITION COMPRISING QUATERNISED POLY-DIMETHYLSILOXANE AND NONIONIC SURFACTANT

Technical Field

The present invention relates to a cleaning composition for hard surfaces, wherein said composition comprises both a quaternised poly-dimethylsiloxane and a nonionic surfactant.

BACKGROUND TO THE INVENTION

In traditional cleaning of hard surfaces such as wood, glazed tiles, painted metal and the like, it is known to follow soil removal using surfactant or solvent based compositions with the application of a lacquer, wax or polish as a separate operation so as to seal and protect the surface and reduce the rate of soil redeposition. This two-step cleaning and sealing operation is time-consuming and complex.

It is known to incorporate components into a surfactant-based composition with the intention that deposition of such components onto surfaces will provide a protective layer in a one step cleaning operation.

U.S. Pat. No. 3,679,592 (1972) discloses alkaline, cleaning and soil preventative compositions which comprise surfactant and 1-10% wt, particularly 4%, of a film forming component of specified structure having a molecular weight in the range 500 to 100,000. In use, the compositions are said to inhibit stain deposition and assist soil removal.

GB 1528592 (1978) discloses alkaline, floor cleaning compositions which comprise an organic, polycarboxylic acid co-polymer having a molecular weight in the range 100,000–2,500,000 which is soluble in aqueous solutions having a pH of 8.5 or above. These polymers are readily available in commercial quantities.

GB 1534722 (1978) discloses granular hard surface cleaning compositions which comprise surfactant and, as "a soil removal improvement mixture", a polyvinyl alcohol or pyrrolidone and a biopolysaccharide. These polymers have molecular weights ranging from around 5000 to around 360,000 and are available in industrially useful quantities. The compositions form alkaline solutions.

U.S. Ser. No. 07/297,807, as described in EP 0467472 A2 (Colgate Palmolive) demonstrates that the incorporation of 2.3% of a 15–20% aqueous solution of the cationic polymer poly[beta(methyl diethyl-ammonium) ethyl-methacrylate] in a mixed nonionic surfactant system for hard surface cleaning results in significant improvement of ease of subsequent re-cleaning of previously soiled and cleaned ceramic tiles.

EP 0467472 A2 discloses that soil release promoting polymers such as, but not limited to, the cationic poly[beta (methyl diethyl-ammonium)ethyl-methacrylate] are also effective in combination with anionic and cationic surfactant. In that published application it is stated that 'said adsorbed polymer forms a residual anti-soiling hydrophillic layer of said soil release promoting polymer on said surface, whereby removal of soils subsequently deposited thereupon requires less work than in the absence of said residual layer'. The molecular weight range of the polymers falls into the range 4,000–100,000 although the use of polymers having a molecular weight above 50,000 is discouraged for solubility reasons.

EP 0379256 discloses similar compositions to the above-mentioned document, having up to 2% wt of an optional quaternised, anti-static, polymer of molecular weight in the range of 2,000–500,000, and being characterised by an acidic pH of 2–4 and a 2–4% wt of a nonionic surfactant system. Specific examples relate to compositions having a pH of 2.5 and comprising 2.2% wt of a mixed nonionic system and 0.07% of the specified cationic polymer. The modified polymer is again said to function as a soil release agent.

In addition to the above it is known from U.S. Pat. No. 4,606,842 to use low molecular weight polyacrylic resins as a builder in glass cleaning compositions of the spray-on, wipe-off type. Baker et. al. in U.S. Pat. No. 4,690,779 discloses the use of the combination of polymers of polyacrylic acid having a molecular weight below 5000 with certain nonionic surfactants in hard surface cleaning compositions. The primary function of the polymer in these systems is as a builder.

From the above it can be seen that it is known to include certain polymers in generally alkaline hard surface cleaning compositions with so as to obtain either a primary cleaning benefit when the composition is first used on the surface or a secondary cleaning benefit by modification of the surface so as hinder soil deposition or otherwise facilitate repeated cleaning.

Some attention has been paid to other surface treatment agents, including specific cationic detergents. WO 91/09930 (Ques industries) discloses the use of 'ETHOQUAT' (TM) on aluminium e.g. metal surfaces such as those found on vehicles.

BRIEF DESCRIPTION Of THE INVENTION

We have devised improved compositions which both clean a surface and are believed to deposit thereupon a layer of cationic surfactant which assists the release of soil subsequently deposited upon the said surface.

Accordingly the present invention provides an aqueous, hard-surface cleaning composition comprising surfactant, wherein said surfactant comprises:

a) at least 65% wt on total surfactant of nonionic surfactant, b) less than 1% wt on total surfactant of anionic surfactant, and, c) 0.1–35% wt on total surfactant of a substantially water-soluble quaternised polydimethylsiloxane.

DETAILED DESCRIPTION OF THE INVENTION

Typically, the cationic surfactant comprises a cation of the general formula:

$$[R_1R_2R_3N—Z—[Si(CH_3)_2—O]_nSi(CH_3)_{2-Z-NR4}R_5R_6]^{2+}$$

wherein $R_1$, $R_2$, $R_3$, $R_4$, $R_5$ and $R_6$ are independently alkyl or hydrogen, Z is a linking group and n is 1–200.

Suitable cationic surfactants are disclosed in U.S. Pat. No. 4,891,166.

Preferably $R_1$ and $R_6$ are >C6 alkyl.

Preferably Z is a bivalent hydrocarbon group with at least 4 carbon atoms, which may be interrupted by an oxygen atom. Preferably Z is $—CH_2—CHOH—CH_2O—(CH_2)_3—$.

Preferably, $R_{2-3}$ and $R_{4-5}$ are independently $C_{1-6}$ alkyl or hydrogen. It will be noted that in such a configuration the molecule is highly symmetrical, having a quaternised nitrogen at both ends.

Preferably n is 8–100, most preferably 10–80.

Particularly preferred cationic surfactant materials are TEGOPREN 6920™, TEGOPREN 6922™ and TEGOPREN 6924™ which are believed to contain a cation as described above.

It is believed that the cationic surfactants present in the compositions of the present invention modify the surface energy of surfaces to which the composition is applied so as to raise the contact angle of soil subsequently deposited on the modified surface. This also has the effect of making the surface hydrophobic. Users of compositions according to the present invention have also noted that on relatively smooth surfaces there is a modification of the interaction of the cloth with the surface during cleaning. This is described as a 'gliding' or 'sliding' sensation. It is believed that this reduction of the apparent friction between the cloth and the surface makes the cleaning operation seem to require considerably less effort. While the results given below show that effort is indeed reduced it is believed that the user may consider that the effort is being reduced to an even lower level on many surfaces.

Preferred cationics have a marked effect on the contact angle of test liquids which are applied to surfaces which have been treated with said cationics. Thus, for glass which has been untreated the contact angle of a 10 microliter dodecane droplet is less than 5 degrees. When treated with an composition embodying the present invention, i.e. an aqueous solution of 5% nonionic and 1% cationic, as described in further detail below: the contact angle of the dodecane droplet is increased to typically above 20 degrees.

The present invention extends to a method of cleaning a hard surface which has a net negative charge which comprises treating the surface with a composition according to the product aspects of the present invention.

It is essential that the compositions of the present invention comprise a nonionic surfactant. The presence of nonionic surfactant is believed to contribute significantly to the cleaning effectiveness of the compositions of the invention.

Suitable nonionic surfactant compounds can be broadly described as compounds produced by the condensation of alkylene oxide groups, which are hydrophillic in nature, with an organic hydrophobic compound which may be aliphatic or alkyl aromatic in nature.

The length of the hydrophillic or polyoxyalkylene radical which is condensed with any particular hydrophobic group can be readily adjusted to yield a water-soluble compound having the desired degree of balance between hydrophillic and hydrophobic elements.

Particular examples include the condensation product of aliphatic alcohols having from 6 to 22 carbon atoms in either straight or branched chain configuration with ethylene oxide, such as a coconut oil ethylene oxide condensate having from 2 to 15 moles of ethylene oxide per mole of coconut alcohol; condensates of alkylphenols whose alkyl group contains from 6 to 12 carbon atoms with 5 to 25 moles of ethylene oxide per mole of alkylphenol; condensates of the reaction product of ethylenediamine and propylene oxide with ethylene oxide, the condensates containing from 40 to 80% of polyoxyethylene radicals by weight and having a molecular weight of from 5,000 to 11,000; tertiary amine oxides of structure $R_3N0$, where one group R is an alkyl group of 8 to 18 carbon atoms and the others are each methyl, ethyl or hydroxy-ethyl groups, for instance dimethyldodecylamine oxide; tertiary phosphine oxides of structure $R_3P0$, where one group R is an alkyl group of from 10 to 18 carbon atoms, and the others are each alkyl or hydroxyalkyl groups of 1 to 3 carbon atoms, for instance dimethyldodecylphosphine oxide; and dialkyl sulphoxides of structure $R_2S0$ where the group R is an alkyl group of from 10 to 18 carbon atoms and the other is methyl or ethyl, for instance methyltetradecyl sulphoxide; fatty acid alkylolamides; alkylene oxide condensates of fatty acid alkyloiamides and alkyl mercaptans.

Particularly preferred nonionic surfactants are the ethoxylated alcohols having 6–14 carbons and 2–9 moles of ethoxylation. Suitable materials include IMBENTIN 91/35 OFA (TM), a $C_{10}$ nonionic having on average five moles of ethoxylation.

Many more nonionic surfactants are known to the skilled worker, as set forth in M. J. Schick 'Nonionic Surfactants', Marcel Dekker (1967) and subsequent editions of the same work.

The amount of nonionic surfactant to be employed in the composition of the invention will generally be from 1 to 30% wt, preferably from 2 to 20% wt, and most preferably from 5 to 15% wt.

Hydrophobic oils are optional components of compositions according to the present invention. Suitable oils include oils which rapidly dissolve triglyceride. When oils are present preferred oils include limonene, para-cymene, di-butyl ether and butyl butyrate.

It is essential that the compositions of the present invention only comprise low levels of anionic detergent actives or that these actives are absent in so far as is practical. It is believed that the presence of anionic detergents will cause the formation of a complex between the cationic and anionic detergents which will reduce the effectiveness of the compositions.

It is particularly preferred that the ratio of nonionic surfactant to anionic and cationic surfactant is such that >75% of the total surfactant present in the composition is nonionic.

The composition according to the invention can contain other ingredients which aid in their cleaning performance.

For example, the composition can contain detergent builders such as carbonates and bicarbonates, nitrilotriacetates, polycarboxylates, citrates, dicarboxylic acids, water-soluble phosphates especially polyphosphates, mixtures of ortho- and pyrophosphate, zeolites and mixtures thereof. Such builders particularly the phosphates and the carbonates can also function as abrasives if present in an amount in excess of their solubility in water: although it ms preferable that the compositions of the present invention are essentially free of abrasive particles where rinsing difficulties or surface damage may occur. In general, the builder, will form from 0.1 to 25% by weight of the composition.

Metal ion sequestrants such as ethylenediaminetetraacetates, amino-polyphosphonates (DEQUEST®) and phosphates and a wide variety of other poly-functional organic acids and salts, can also optionally be employed.

A further optional ingredient form compositions according to the invention is a suds regulating material, which can be employed in those compositions according to the invention which have a tendency to produce excessive suds in use. Examples of suds regulating materials are organic solvents, hydrophobic silica and silicone oils or hydrocarbons.

Compositions according to the invention can also contain, in addition to the ingredients already mentioned, various other optional ingredients such as pH regulants, colourants, rheological control agents (including polymers), optical brighteners, soil suspending agents, detersive enzymes, compatible bleaching agents, gel-control agents, freeze-thaw stabilisers, bactericides, preservatives, detergent hydrotropes perfumes and opacifiers.

Solvents may be present in the compositions of the invention. Typical solvents include alcohols and ethers, particularly mono and di alkyl ethers, alkyl polyethers, and polyethers per se and N-methyl pyrrolidinones. Solvents are preferably present at levels of 3–20% wt, with levels of 5–10% being particularly preferred. Glycol ether and/or lower alcohols having 1–5 carbons are preferred as solvents although the use of short alkyl chain esters including ethyl acetate is also envisaged.

Preferably, the solvent is selected from: propylene glycol mono n-butyl ether, dipropylene glycol mono n-butyl ether, propylene glycol mono t-butyl ether, dipropylene glycol mono t-butyl ether, diethylene glycol hexyl ether, methanol, ethanol, isopropyl alcohol, ethylene glycol monobutyl ether, di-ethylene glycol monobutyl ether, N-methyl pyrrolidinone and mixtures thereof.

Particularly preferred solvents are selected from the group comprising ethanol (preferably as industrial methylated spirits), propylene glycol mono n-butyl ether (available as 'Dowanol PnB'[RTM]) N-methyl pyrrolidinone (available as such) and di-ethylene glycol monobutyl ether (available as 'Butyl Digol'[RTM] or 'Butyl Carbitol'[RTM]). These solvents are preferred due to cost, availability and safety factors. We have determined that this selection of solvents gives enhanced cleaning performance as regards inks and dyestuffs.

In embodiments where the cleaning of burnt on or otherwise crosslinked soils is envisaged, it is particularly preferred that the composition comprises 1–10% of an alkanolamine, with levels of 2–6% wt being particularly preferred.

Particularly suitable alkanolamines include: 2-amino-2-methyl-1-propanol, mono-ethanolamine and di-ethanolamine.

We have determined that it is particularly advantageous to include a polymer in the compositions of the present invention so as to reduce the level of formation of exceptionally fine droplets when the composition is sprayed as a relatively fine mist. Suitable polymers include polyvinyl pyrrolidone, available in the marketplace as Polymer PVP K-90.

Suitable levels of PVP polymer range upwards from 50 ppm. Levels of 300–2000 ppm are particularly preferred.

While the compositions of the present invention can be alkaline, acidic or neutral, it is preferred for kitchen soils that the compositions are generally alkaline, having a preferred pH >6.

Particularly preferred compositions have a pH of >10 and comprise, in admixture with water,:

a) 3–15% nonionic surfactant (preferably, C9-C12 EO5-8 nonionic surfactant)

b) 2–10% solvent (preferably, diethylene glycol mono-n-butyl ether)

c) 2–6% alkanolamine (preferably, 2-amino-2-methyl-1-propanol)

d) 0–5% buffer/alkali (preferably, an alkali metal carbonate), e) 0–2000 ppm Polymer (preferably, PVP), and f) 0.1–2% of a cationic surfactant comprises a cation of the general formula:

$$[R_1R_2R_3N—Z—[Si(CH_3)_2—O]_nSi(CH_3)_2—Z—NR_4R_5R_6]^{2+}$$

wherein $R_1$, $R_2$, $R_3$, $R_4$, $R_5$ and $R_6$ are independently alkyl or hydrogen, Z is $—CH_2—CHOH—CH_2O—(CH_2)_3—$ and n is 1–200, said composition being packaged in a container adapted to produce a spray of 0.1–1.5 ml of product per spraying operation, said spray having an average drop size in the range 30–300 microns.

In order that the present invention may be better understood it will be described hereinafter by way of example.

EXAMPLES

Aqueous compositions comprising 5% nonionic surfactant, and a relatively low level of cationic surfactant were prepared as in Table 1 below: using the following materials:

NONI: IMBENTIN 91/35 OFA

CTAB: Cetyl trimethyl ammonium bromide catA: TEGOPREN 6920 (n=10)

catB: TEGOPREN 6922 (n=30)

catC: TEGOPREN 6924 (n=80)

Results 'ETh' and 'EPh' are explained below. CTAB, a typical single chain alkyl cationic surfactant was selected as a control as it has a significantly lower effect on the contact angle of a dodecane droplet placed on a glass slide which has been treated with a 1% solution of cationic in a 5% aqueous solution of NONI. These contact angles are given below in Table 1 as 'Angle' scores.

The surface energy $gamma_s/mN.m^{-1}$ of the CTAB treated surface is believed to be of the order of 25 $mN.m^{-1}$, whereas the surface energy of surfaces treated with similar solutions of the cationics used in the compositions of the present invention was less than 25 $mn.m^{-1}$.

TABLE 1

| Example Comp: | 1 | 2 | 3 | 4 | 5 | 6 | 7 |
|---|---|---|---|---|---|---|---|
| NONI | 5% | 5% | 5% | 5% | 5% | 5% | 5% |
| CTAB | — | 1% | — | — | — | — | — |
| catA | — | — | 1% | — | — | — | — |
| catB | — | — | — | 1% | — | — | — |
| catC | — | — | — | — | .01% | .1% | 1% |
| ETh | high* | high* | — | — | high* | 9615 | 1290 |
| EPh | 2634 | 1697 | 1327 | 916 | — | 1797 | 1228 |
| Angle | <10 | ~10 | — | — | — | — | 25 |
| $Gamma_s$ | >25 | 25 | — | — | — | — | 23.1 |

high* indicates that the tile was not clean in less than 2 minutes i.e. the cleaning effort was believed to be of the order of 10000 Ns.

TABLE 2

| Example Comp: | 8 | 9 | 10 | 11 | 12 |
|---|---|---|---|---|---|
| NONI | 10% | 10% | 10% | 10% | 10% |
| AMP | 4% | 4% | 4% | 4% | 4% |
| $K_2CO_3$ | 1.2% | 1.2% | 1.2% | 1.2% | 1.2% |
| Digol | 8% | 8% | 8% | 8% | 8% |
| CTAB | — | 1% | — | — | — |
| catB | — | — | 0.1% | 0.5% | 1.0% |
| Eth | 930 | 469 | 1051 | 150 | 132 |

To prepare the soiled surfaces for the examples, 100 g dehydrated castor oil (ex. UNICHEMA) was weighed into a glass jar. To this was added 0.2 g Fat Red™ dye (ex. SIMGA) and the mixture was stirred vigorously (2000 RPM) for 6 hours using a Heidolph stirrer. The stirred mixture was refrigerated when not in use.

Vitreous enamel times (380×300 mm) were cleaned using a fresh damp J-CLOTH™ using, in sequence, JIF LAC™, a commercially available brand of hand dishwashing liquid and calcite powder. After drying residual calcite was removed by buffing with a paper towel.

1 ml of the compositions listed in Table 1 was wiped onto the cleaned tiles using a fresh damp J-CLOTH. The tiles were rinsed with tap water for 15 seconds to remove excess composition and allowed to drain. The pre-treated tiles were soiled over a 215×150 mm area using a DeVilbiss (TM) gravity feed spray gun (MODEL MPS-514/515) using compressed air at 25 psi, by spraying from 27 cm for 35 seconds. The soiled tiles were either laid horizontally in an oven at 85 Celcius and thermally aged for 2 hours (then left overnight) or aged photochemically (by exposure to daylight for 3–6 days). Tiles were cleaned by hand using damp J-cloths and 1–2 ml of a control composition which comprised the formulation given in table 3 below:

TABLE 3

| control formulation | |
|---|---|
| 5% | NONI |
| 3.4% | AMP |
| 0.2M | $K_2CO_3$ |
| 5% | N-methyl pyrollidone |

The effort required to clean the tiles was determined as 'ETh' in table 1 for thermally aged tiles and 'EPh' for photochemically aged tiles.

2 ml of the compositions listed in Table 2 were wiped onto the cleaned tiles using a fresh damp J-CLOTH. The tiles were soiled and aged as described above and cleaned with same formulation as used in pre-treatment rather than the control.

From the results presented in table 1 it can be seen that the compositions according to the present invention, show a marked reduction in the cleaning effort required as compared with comparable compositions which either contain no cationic surfactant or contain an alternative cationic surfactant. From the results in table 2 it can be seen that cationic quaternary material continues to show a relative reduction in the cleaning effort required in fully formulated products.

In addition to the above it was noted that for mirror tiles and glass microscope slides which had been cleaned with compositions according to the invention (i.e. 5% IMBENTIN 91/35 OFA plus 1% TEGOPREN 6922), there was a reduction in the drag noted with a dry paper tissue pushed across the surface in comparison with surfaces which had simply been cleaned with an equivalent nonionic composition containing no cationic quaternary material (i.e. 5% nonionic).

A further point which was noted in trials was that surfaces which had been treated with the compositions according to the present invention were not only easier to clean (in terms of the effort required) but appeared to remain cleaner for longer. It is believed that this may be due to the surface modification preventing the spread of soils, due to the high contact angle of the soil on the treated surfaces.

I claim:

1. Aqueous, hard-surface cleaning composition comprising surfactant, wherein said surfactant consists essentially of:

a) at least 65% wt of total surfactant of nonionic surfactant, b) less than 1% wt of total surfactant of anionic surfactant, c) 0.1–35% wt of total surfactant of a quaternised polydimethylsiloxan, and d) water.

2. Composition according to claim 1, wherein said quaternised polydimethylsiloxane comprises a cation of the general formula:

$$[R_1R_2R_3N—Z—[Si(CH_3)_2—O]_nSi(CH_3)_2—Z—NR_4R_5R_6]^{2+}$$

wherein $R_1$, $R_2$, $R_3$, $R_4$, $R_5$ and $R_6$ are independently alkyl or hydrogen, Z is a linking group and n is 1–200.

3. Composition according to claim 2, wherein n is 8–100.

4. Composition according to claim 1 wherein the nonionic surfactants comprises an ethoxylated alcohols having 6–14 carbons and 2–9 moles of ethoxylation.

5. Composition according to claim 1 comprising 1 to 30% wt nonionic surfactant.

6. Composition according to claim 1 further comprising, 1–10% of an alkanolamine.

7. Composition according to claim 1 further comprising, a builder selected from the group comprising carbonates and bicarbonates, nitrilotriacetates, polycarboxylates, citrates, dicarboxylic acids, water-soluble phosphates especially polyphosphates, mixtures of ortho-and pyrophosphate, zeolites and mixtures thereof.

8. Composition according to claim 1 having a pH of >10 and comprising:

a) 3–15% nonionic surfactant, b) 2–10% solvent, c) 2–6% alkanolamine, d) 0–5% buffer/alkali, e) 0–2000 ppm polymer, f) 0.1–2% of a cationic surfactant comprises a cation of the general formula:

$$[R_1R_2R_3N—Z—[Si(CH_3)_2—O]_nSi(CH_3)_2—Z—NR_4R_5R_6]^{2+}$$

wherein $R_1$, $R_2$, $R_3$, $R_4$, $R_5$ and $R_6$ are independently alkyl or hydrogen, Z is $—CH_2—CHOH—CH_2O—(CH_2)_3—$ and n is 1–200, and g) water.

9. A method of cleaning a hard surface which has a net negative charge which comprises treating the surface with a composition according to claim 1.

* * * * *